United States Patent [19]

Mallory

[11] Patent Number: 5,062,819

[45] Date of Patent: Nov. 5, 1991

[54] TOY VEHICLE APPARATUS

[76] Inventor: Mitchell K. Mallory, 403 Kinsey St., Richmond, Ind. 47374

[21] Appl. No.: 646,818

[22] Filed: Jan. 28, 1991

[51] Int. Cl.[5] ..... A63H 29/22

[52] U.S. Cl. ..... 446/462; 446/484

[58] Field of Search ..... 446/462, 457, 464, 471, 446/470, 484

[56] References Cited

U.S. PATENT DOCUMENTS 3,512,298 5/1970 Poynter ..... 446/484 X 4,329,810 5/1982 Terui ..... 446/457

4,492,058 1/1985 Goldfarb et al. ..... 446/462

*Primary Examiner*—Mickey Yu

*Attorney, Agent, or Firm*—Leon Gilden

[57] ABSTRACT

A self-propelled vehicle is arranged wherein a coin receiving slot is provided within the vehicle body that is removably mounted relative to a vehicle chassis to permit replacement of the vehicle body by various configurations. Each of such bodies includes a support plate for directing an associated coin disk into the associated slot to complete an electrical circuit energizing a motor, and accordingly driving forward and rear wheels of the vehicle.

1 Claim, 4 Drawing Sheets

TOY VEHICLE APPARATUS

BACKGROUND OF THE INVENTION

1. Field of the Invention

The field of invention relates to toy vehicles, and more particularly pertains to a new and improved toy vehicle apparatus wherein the same provides for a child and the like to effect actuation of the vehicle by directing a metallic coin into the vehicle completing a circuit and effecting actuation of the vehicle.

2. Description of the Prior Art

Various toy apparatus has been provided in the prior art, and particularly the use of toy vehicles of self-propelled construction have been utilized for amusement and educational dunderstanding of relative motion for children and the like. Such apparatus typically is of a wind-up or selective switching, but heretofore has not provided children with an understanding of electrical completion of circuitry or alternatively, the use of monetary denominations to effect actuation of various devices. Examples of the prior art include U.S. Pat. No. 4,889,516 to Auer, et al. seting forth modules that may be mounted within associated vehicles to permit use of the module to drive one of a plurality of vehicles.

U.S. Pat. No. 4,824,413 to Perkitny sets forth a toy vehicle wherein the power pack is rotatably mounted to effect driving of the vehicle in a plurality of directions.

U.S. Pat. No. 4,652,247 to Goldfarb, et al. sets forth an example of a motorized vehicle with steerable water jets.

U.S. Pat. No. 4,695,267 to Simmel, et al. and U.S. Pat. No. 3,628,284 to Soulakis are further examples of scaled down, motorized vehicles in a toy configuration.

As such, it may be appreciated that there continues to be a need for a new and improved toy vehicle apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of toy vehicle apparatus now present in the prior art, the present invention provides a toy vehicle apparatus wherein the same provides for a chassis removably mounted relative to an overlying body, and wherein the chassis is motivated by positioning of a metallic coin through the body into the chassis to effect actuation of an associated electric drive motor. As such, the general purpose of the present invention, which will be described subsequently in greater detail, is to provide a new and improved toy vehicle apparatus which has all the advantages of the prior art toy vehicle apparatus and none of the disadvantages.

To attain this, the present invention provides a self-propelled vehicle arrangement wherein a coin receiving slot is provided within the vehicle body that is removably mounted relative to a vehicle chassis to permit replacement of the vehicle body by various configurations. Each of such bodies includes a support plate for directing an associated coin disk into the associated slot to complete an electrical circuit energizing a motor, and accordingly driving forward and rear wheels of the vehicle.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toy vehicle apparatus which has all the advantages of the prior art toy vehicle apparatus and none of the disadvantages.

It is another object of the present invention to provide a new and improved toy vehicle apparatus which may be easily and efficiently manufactured and marketed.

It is a further object of the present invention to provide a new and improved toy vehicle apparatus which is of a durable and reliable construction.

An even further object of the present invention is to provide a new and improved toy vehicle apparatus which is susceptible of a low cost of manufacture wit regard to both materials and labor, and which accordingly is then susceptible of low prices of sale to the consuming public, thereby making such toy vehicle apparatus economically available to the buying public.

Still yet another object of the present invention is to provide a new and improved toy vehicle apparatus which provides in the apparatuses and methods of the prior art some of the advantages thereof, while simultaneously overcoming some of the disadvantages normally associated therewith.

Still another object of the present invention is to provide a new and improved toy vehicle apparatus wherein the same accommodates a metallic coin directed in a slot to effect actuation of the associated associated toy vehicle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS.

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
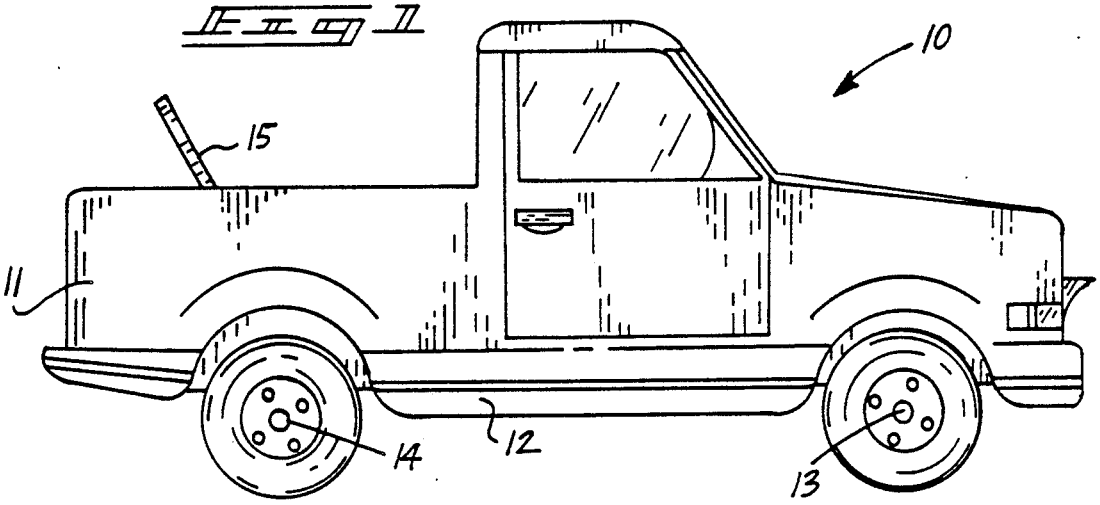
FIG. 1 is an orthographic side view of the instant invention.
Figure 2:
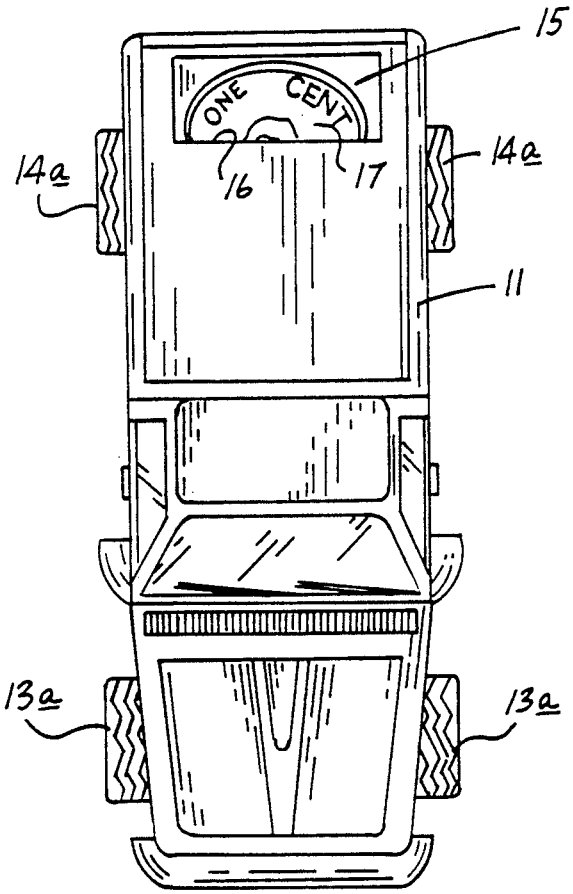
FIG. 2 is an orthographic top view of the instant invention.
Figure 3:
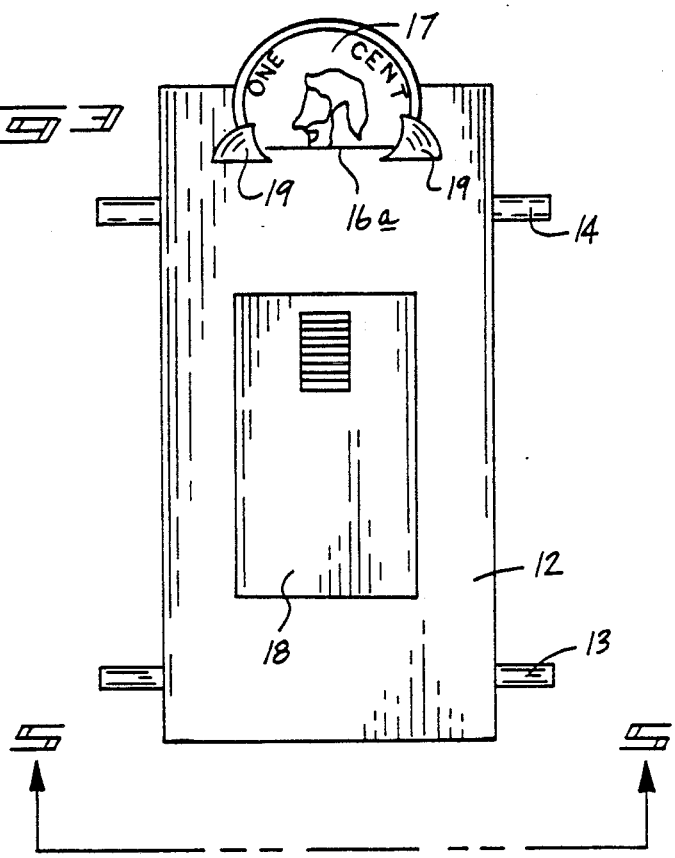
FIG. 3 is an orthographic top view of the chassis with the wheels and body removed therefrom.
Figure 4:
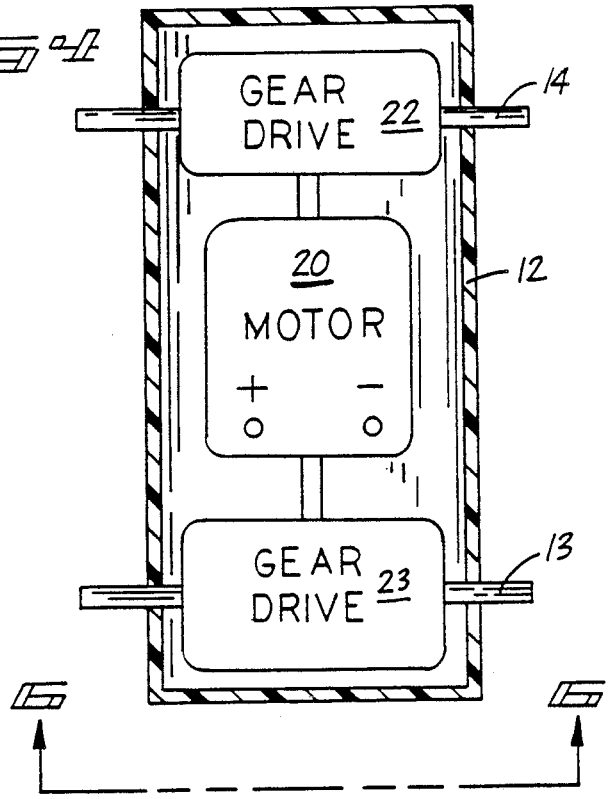
FIG. 4 is an orthographic cross-sectional view of the chassis illustrating the medially mounted motor and drive gearing at each end of the chassis.
Figure 5:
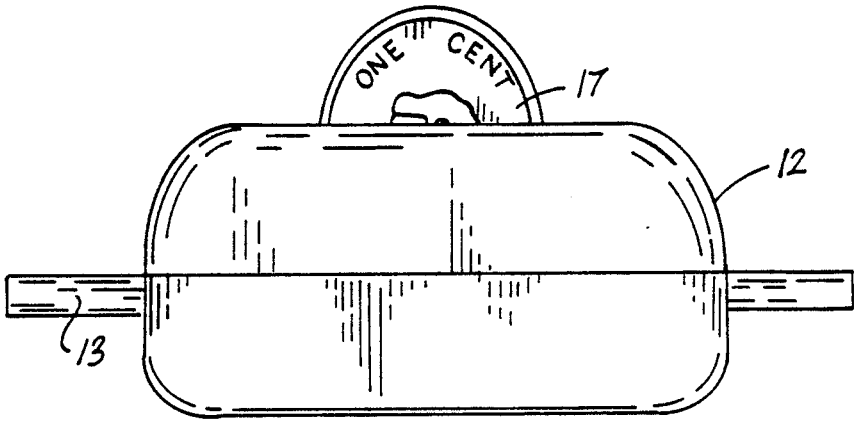
FIG. 5 is an orthographic view, taken along the lines 5—5 of FIG. 3 in the direction indicated by the arrows.
Figure 6:
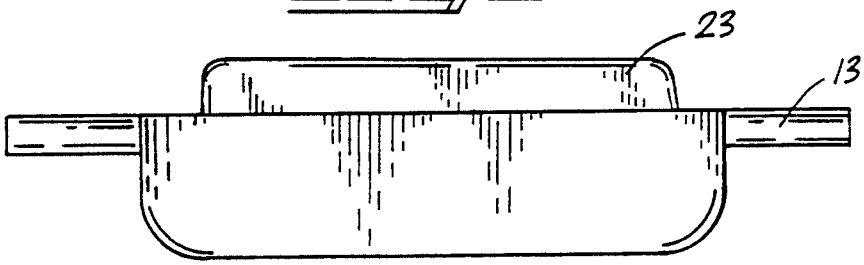
FIG. 6 is an orthographic view, taken along the lines 6—6 of FIG. 4 in the direction indicated by the arrows.
Figure 7:
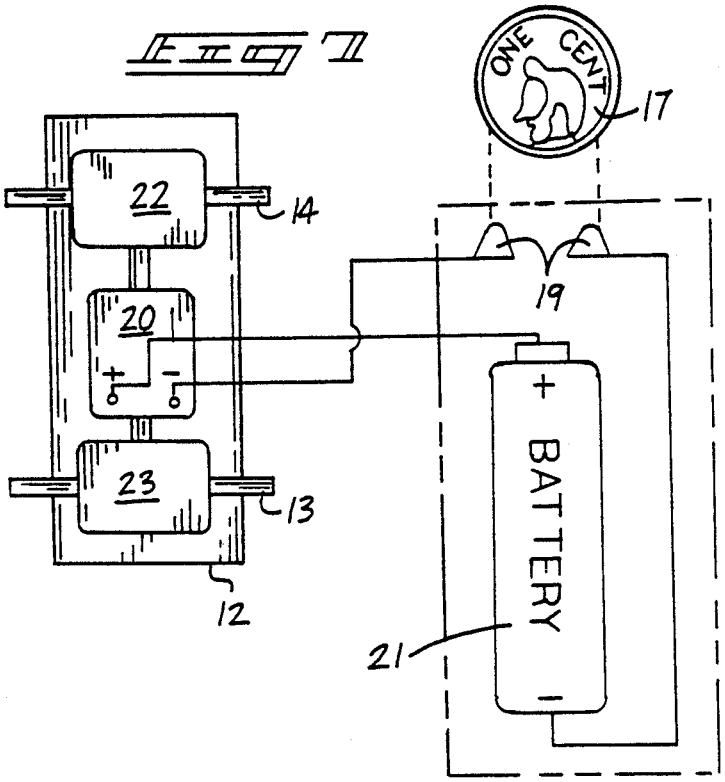
FIG. 7 is a schematic illustration of the instant invention illustrating the circuitry in association with the drive motor of the instant invention.
Figure 8:
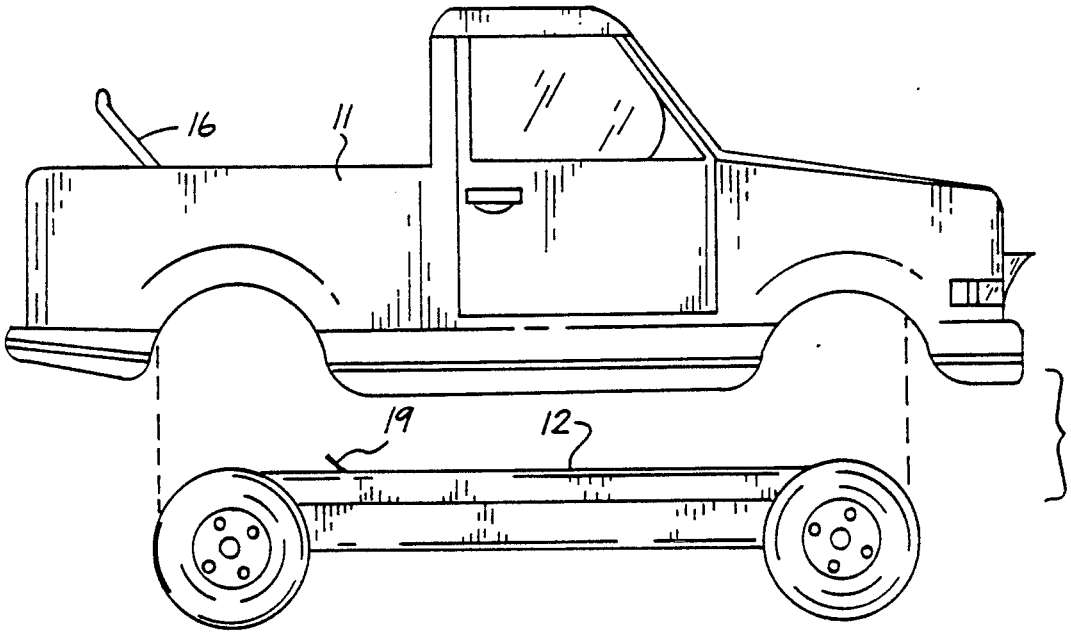
FIG. 8 is an orthographic side view of the chassis removably mounted relative to an overlying body.

With reference now to the drawings, and in particular to FIGS. 1 to 8 thereof, a new and improved toy vehicle apparatus embodying the principles and concepts of the present invention and generally designated by the reference numeral 10 will be described.

More specifically, the toy vehicle apparatus 10 of the instant invention includes a vehicle body 11 removably mounted relative to an underlying vehicle chassis 12. The vehicle body 11 may be in one of a plurality of configurations, but it is understood that the wheel wells, as illustrated, are oriented to overlie and accommodate a forward axle 13 and a rear axle 14 rotatably mounted within the chassis, with the forward and rear axles 13 and 14 each including a plurality of forward wheels **13*a* and rear wheels 14*a* respectively. The vehicle body 11 includes a coin supporting plate 15 mounted at an obtuse included angle between a forward portion of the chassis and an upper surface of the inclined coin support plate 15. The coin support plate 15 aligns an associated metallic coin disk 17 positioned upon the coin support plate 15 through a slot 16, with the slot 16 directed through the chassis and aligned with a further slot 16*a* to align the metallic coin disk 17 between spaced electrical contacts 19. A drive motor battery 21 is positioned within a battery cover 18 within the chassis 12, wherein the drive motor 20 is accordingly actuated when the metallic coin disk 17 is positioned between the contacts 19 to drive the drive motor 20 and associated rear and forward gear drives 22 and 23 to effect rotation of the rear and forward axles 13 and 14** respectively.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A toy vehicle apparatus comprising, an elongate vehicle chassis, the vehicle chassis including a forward rotatable axis mounted within a forward portion of the chassis, and a rear axle rotatably mounted within a rear portion of the chassis arranged parallel to the forward axle, with a plurality of forward wheels mounted to the forward axle, and a plurality of rear wheels to the rear axle, and a vehicle body removably mounted relative to and overlying the chassis, and wherein the chassis includes a medially positioned drive motor, and a rear gear drive operatively associated with the rear axle, and a forward gear drive operatively associated with the forward axle to effect selective rotation of the forward and rear axle by the forward and rear gear drives, and contact means mounted within the chassis and operatively associated with the vehicle body to effect selective actuation of the drive motor, and wherein the contact means includes a plurality of spaced electrical contacts in electrical communication with a battery, wherein the battery is in electrical communication with the drive motor, whereupon selective electrical communication between the spaced electrical contacts effects selective actuation of the drive motor, and wherein the contact means further includes a coin support plate fixedly mounted on the vehicle body, wherein the coin support plate includes a top surface and the top surface defines an obtuse angle between the top surface and the vehicle chassis, and the coin support plate including a slot mounted at a lower terminal end of the coin support plate, and a further slot mounted within the chassis in alignment with the slot, and a metallic coin disk positionable in contiguous communication with the coin support plate directed through the slot and the further slot to effect selective electrical communication between the spaced electrical contacts.

* * * * *